US006592496B1

(12) United States Patent
Tsou

(10) Patent No.: US 6,592,496 B1
(45) Date of Patent: Jul. 15, 2003

(54) ASCENDING/DESCENDING AND FOLDING STRUCTURE FOR RUNNING EXERCISER

(75) Inventor: Chun Hong Tsou, Kaohsiung (TW)

(73) Assignee: Alilife Industrial Co., Ltd., Taichung Hsien (TW)

( * ) Notice: Subject to any disclaimer, the term of this patent is extended or adjusted under 35 U.S.C. 154(b) by 6 days.

(21) Appl. No.: 10/035,447

(22) Filed: Jan. 4, 2002

(51) Int. Cl.[7] ..... A63B 22/02
(52) U.S. Cl. ..... 482/54
(58) Field of Search ..... 482/51, 54

(56) References Cited

U.S. PATENT DOCUMENTS 6,042,515 A * 3/2000 Wang ..... 482/54
6,193,634 B1 * 2/2001 Hurt ..... 482/54
6,261,209 B1 * 7/2001 Coody ..... 482/54

* cited by examiner

*Primary Examiner*—Glenn E. Richman
(74) *Attorney, Agent, or Firm*—Rosenberg, Klein & Lee

(57) ABSTRACT

An ascending/descending and folding structure for running exerciser. The running board frame is connected with a linking mechanism and driven thereby. A telescopic tube assembly of a supporting device is telescoped so as to move the caster support back and forth for adjusting the inclination of the running board. By means of rotating a threaded rod, a long sleeve of the linking mechanism is telescoped into a short sleeve, whereby the running board frame is turned upward. Therefore, the running board can be electrically folded. In the case that there is no power supply, a user can directly manually turn the running board upward and fold the running board.

4 Claims, 18 Drawing Sheets

ASCENDING/DESCENDING AND FOLDING STRUCTURE FOR RUNNING EXERCISER

BACKGROUND OF THE INVENTION

The present invention is related to an ascending/descending and folding structure for running exerciser. The inclination of the running board can be electrically adjusted and the running board can be electrically folded. In the case that there is no power supply, a user can directly manually turn the running board upward and fold the running board.

FIG. 13 shows a conventional running exerciser including a base seat 50 and a running board frame 51 pivotally mounted on the base seat 50. Opposite caster supports 52 are pivotally mounted on rear end of the running board frame 51. A linking mechanism 53 is drivingly connected between the caster supports 52 and the base seat 50. The linking mechanism 53 via a motor 531 is pivotally mounted on the base seat 50. The motor 531 serves to drive a threaded rod 532.

The motor 531 drives the threaded rod 532 to operate the caster supports 52 at rear end of the running board frame 51 and thus change the inclination thereof. When a user desires to fold the running board frame 51 to reduce the occupied room, the user must manually turn the running board frame 51 upward as shown in FIG. 14. The running board frame 51 is quite heavy so that such procedure is very unsuitable for those having insufficient strength, such as an old man and a rehabilitated patient.

FIG. 15 shows another type of running exerciser in which a driving motor (not shown) is mounted on the base seat 60 for driving the running belt to revolve. A folding unit is disposed under the running board frame 61. The folding unit includes a motor 62 for driving a threaded rod 621 to rotate. In addition, an inclination unit is provided for driving the running board frame 61 to adjust the inclination. The inclination unit has another motor (not shown) mounted on the base seat 60. The motor drives a telescopic rod 63 which is linked with the caster supports 64 under the running board frame 61. Accordingly, the inclination of the running board frame 61 can be adjusted.

The above structure is able to electrically adjust the inclination of the running board frame and fold the running board frame as shown in FIG. 16. The structure includes two motors respectively for driving the caster supports 64 to change the inclination of the running board frame 61 and for folding the running board frame 61. In addition, the structure further includes a motor for driving the running belt. Therefore, the structure totally has three motors so that the cost for the structure is high. Moreover, the structure further includes reducing gear case, threaded rod, etc. so that the structure is relatively complicated. Furthermore, such structure lacks function of manual folding. In case there is no power supply, the user will be unable to fold the running board frame and the running exerciser will occupy much room.

FIG. 17 shows still another type of conventional running exerciser in which a motor 72 is disposed on a pivot section of the running board 70 and the rail 71. The motor 72 serves to drive a threaded rod 73 to rotate. One end of the threaded rod 73 is pivotally connected with a pivot point 74. When the threaded rod 73 is driven by the motor 72, the threaded rod 73 pushes the pivot point 74 to fold the running board 70.

The above structure includes one single motor 72 for driving the running board 70 to electrically fold the same as shown in FIG. 18. Moreover, in case there is no power supply, the running board 70 can be manually folded. However, the force arm for the motor 72 to drive the threaded rod 73 is shorter, while the force arm from the running board 70 to the pivot point 74 is longer. Therefore, the load between the motor 72 and the threaded rod 73 is greater and the motor 72 is likely to damage. Furthermore, it is necessary to use a motor 72 with greater power so that the cost is relatively high. In addition, there is little space below the running board 70. In the case that a larger motor is used, the space will be insufficient to receive the motor. Also, such structure is unable to electrically change the inclination of the running board. An additional motor is required for achieving such function. This also increases the cost.

SUMMARY OF THE INVENTION

It is therefore a primary object of the present invention to provide an ascending/descending and folding structure for running exerciser. The running board frame is connected with a linking mechanism and driven thereby. A telescopic tube assembly of a supporting device is telescoped so as to move the caster support back and forth for adjusting the inclination of the running board. By means of rotating a threaded rod, a long sleeve of the inking mechanism is telescoped into a short sleeve, whereby the running board frame is turned upward. Therefore, the running board can be electrically folded. In the case that there is no power supply, a user can directly manually turn the running board upward and fold the running board.

The present invention can be best understood through the following description and accompanying drawings wherein:

DETAILED DESCRIPTION OF THE PREFERRED EMBODIMENTS

Figure 1:
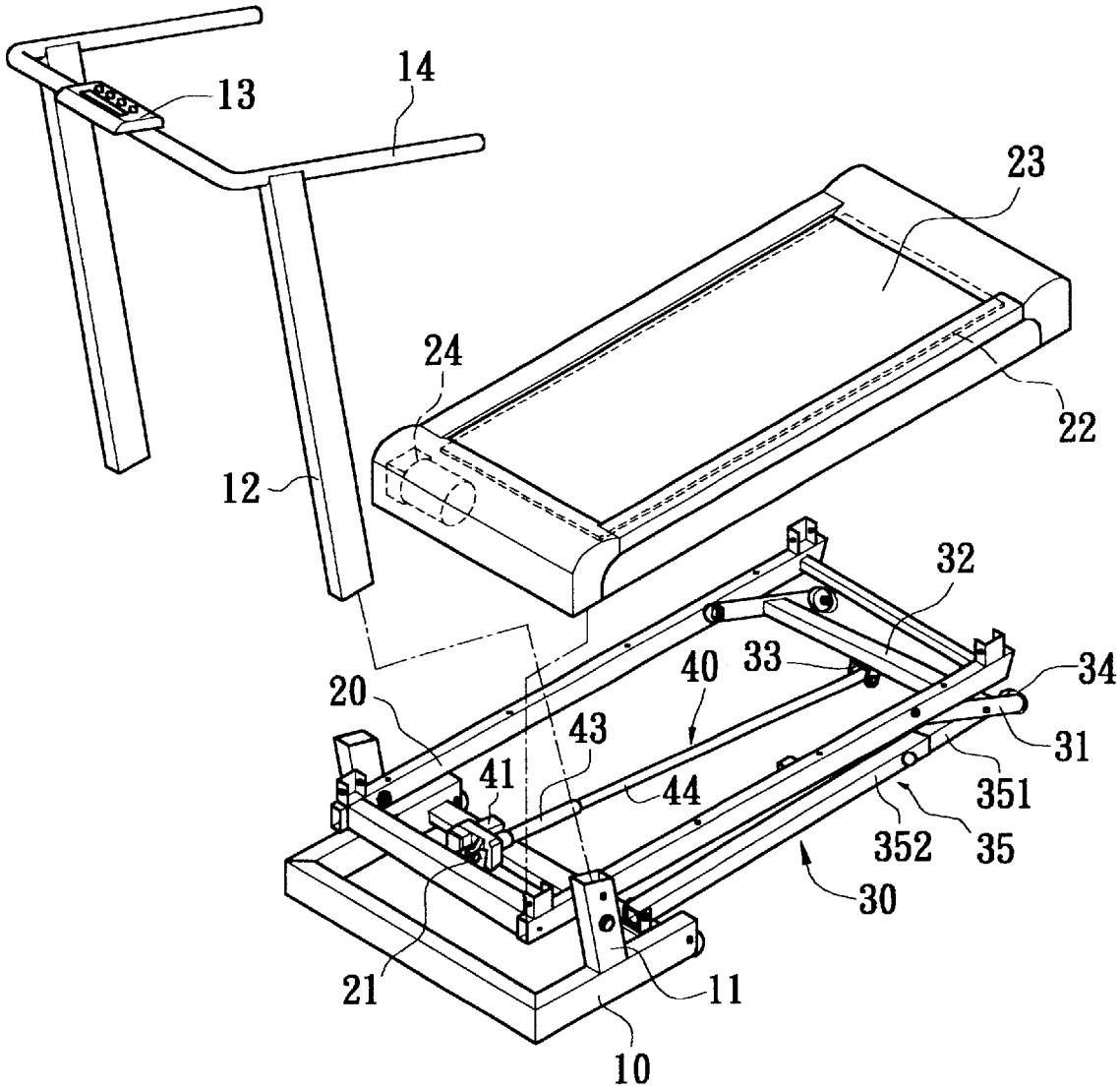
FIG. 1 is a perspective exploded view of the present invention.
Figure 2:
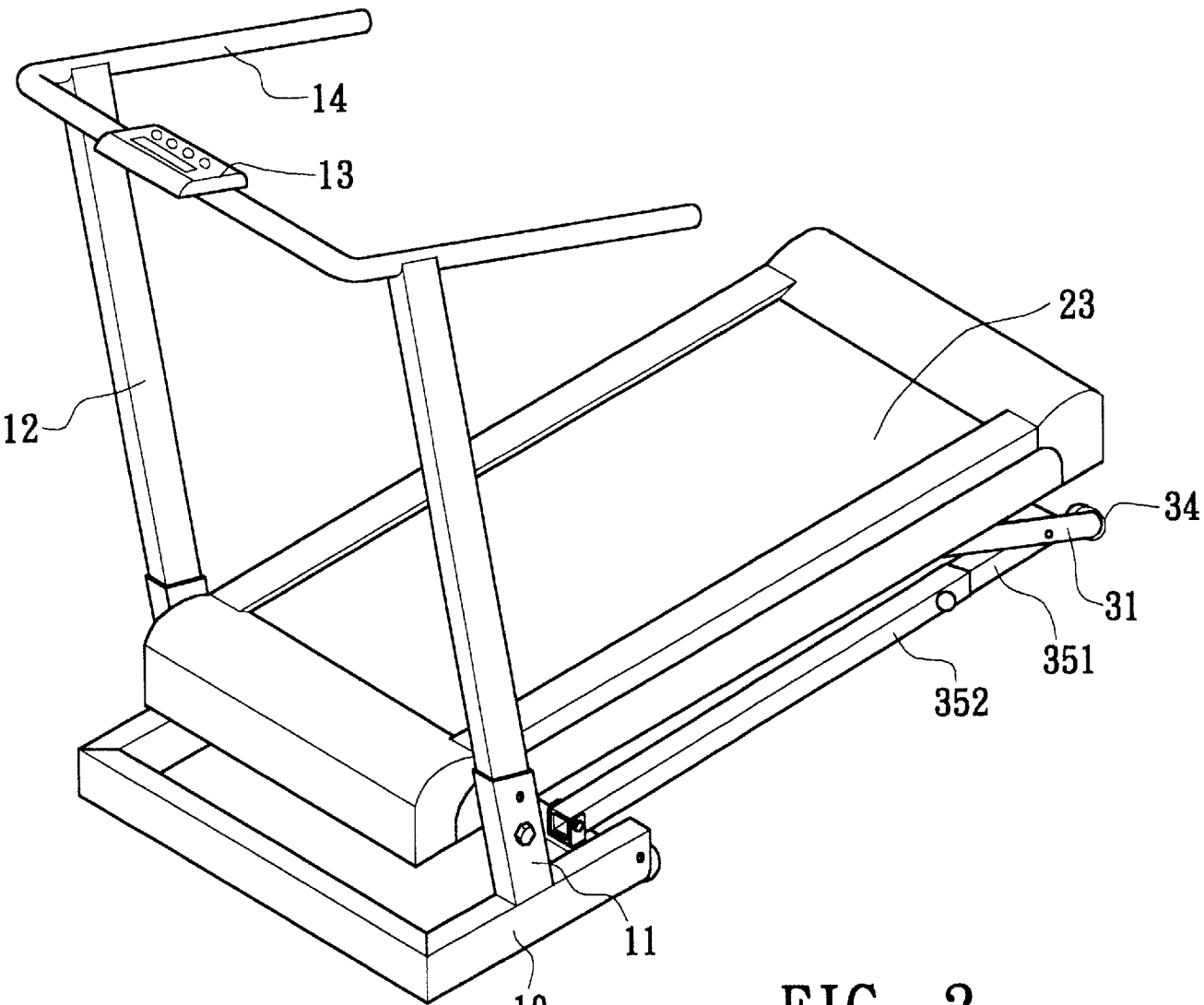
FIG. 2 is a perspective assembled view of the present invention.
Figure 3:
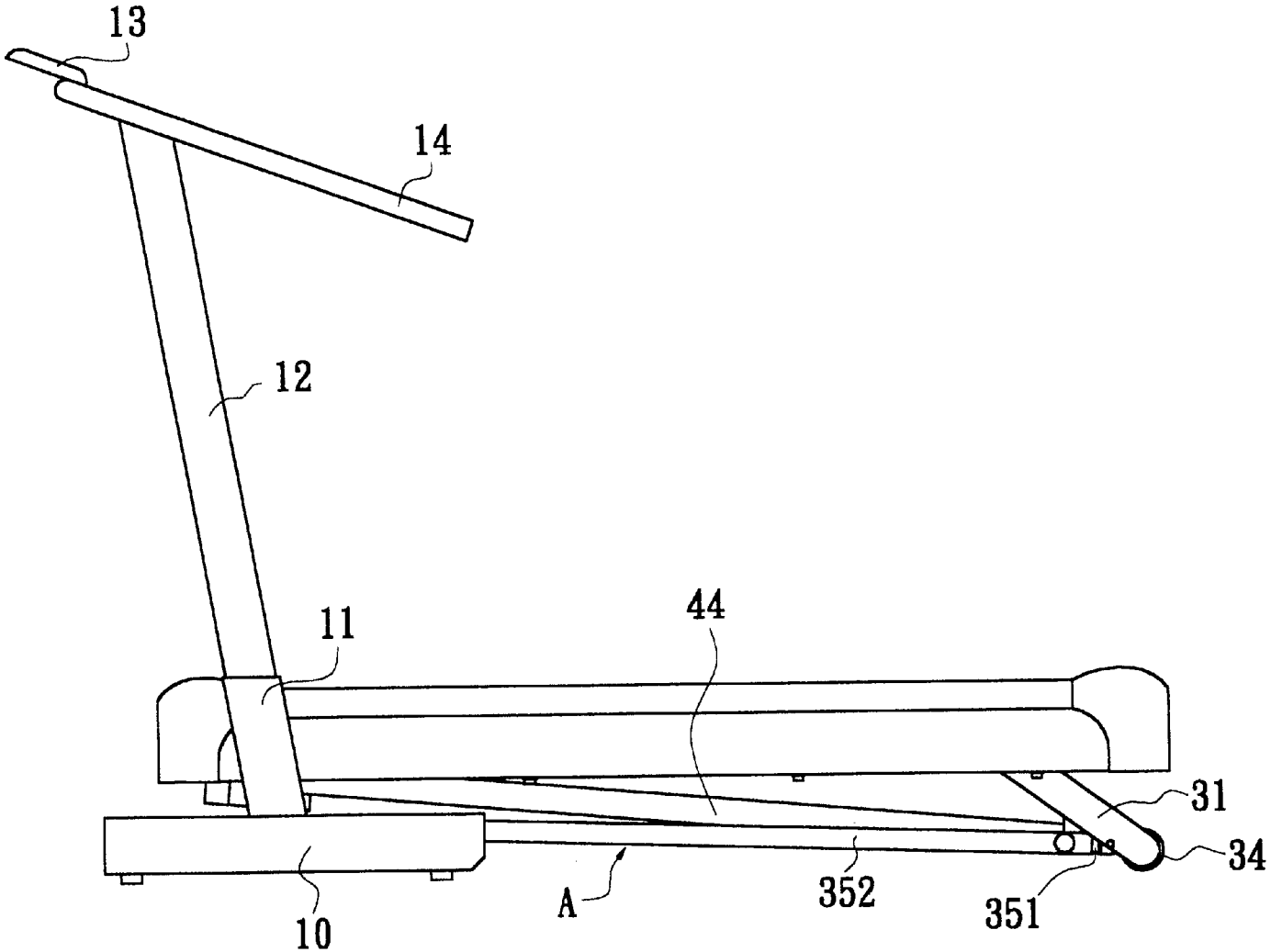
FIG. 3 is a side assembled view of the present invention.
Figure 4:
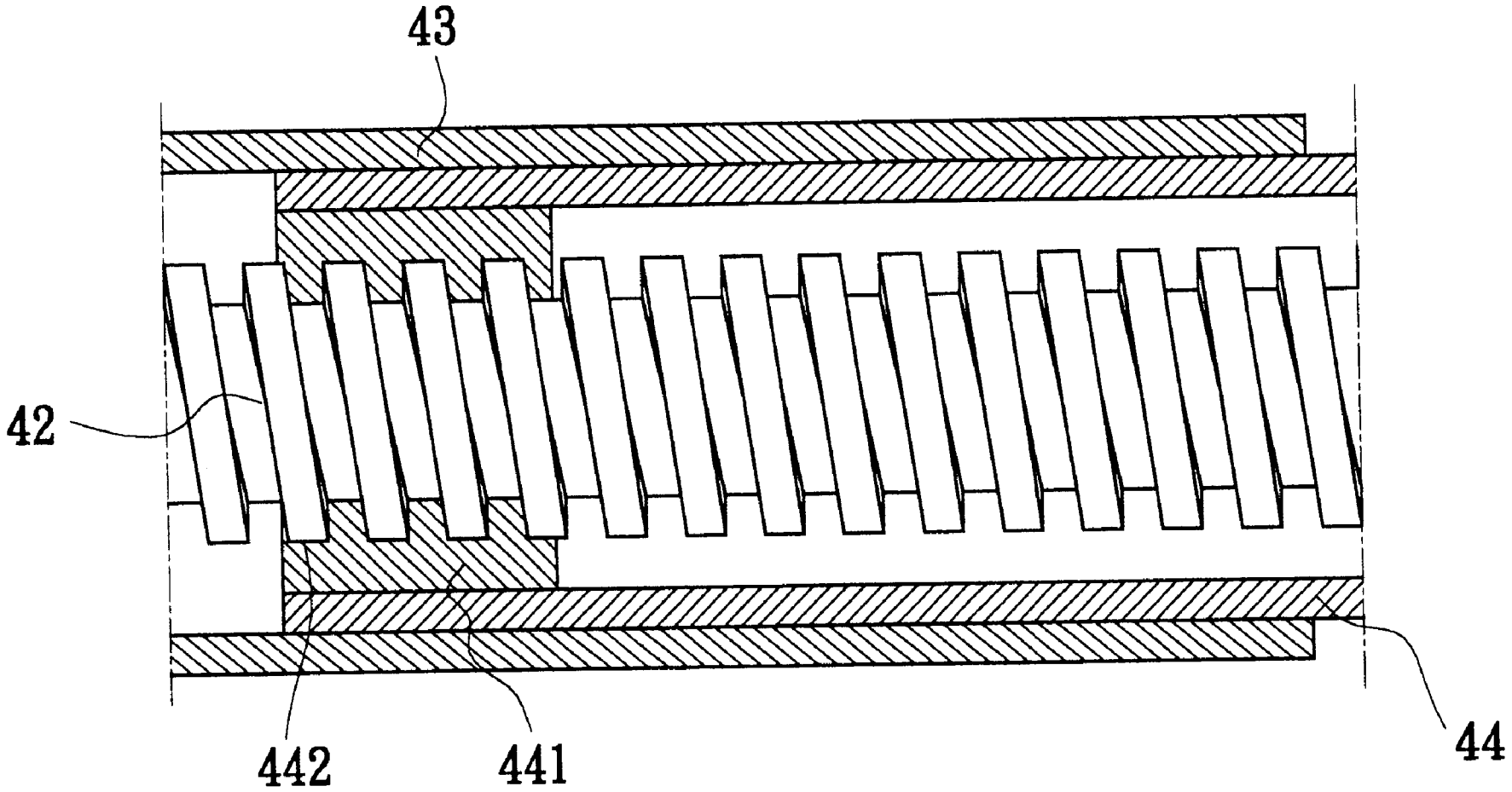
FIG. 4 is a sectional assembled view of the long sleeve and short sleeve of the present invention.

Please refer to FIGS. 1 to 4. The ascending/descending and folding structure for running exerciser of the present invention includes a base seat 10 and a running board frame 20 pivotally mounted on the base seat 10. The running board frame 20 is connected with a supporting device 30 which is drivingly connected with a linking mechanism 40, whereby the running board frame 20 can be inclined by different angles.

The base seat 10 is substantially rectangular. Two upright frames 11 are respectively disposed on two sides of the base seat 10. An upright column 12 is fitted in each upright frame 11. A rail 14 having a controller 13 is connected between the two upright columns 12.

The running board frame 20 is a rectangular frame body composed of four beam members connected with each other. The front end of the running board frame 20 is pivotally mounted between the two upright frames 11 of the base seat 10. A first hinge 21 is fixed on the running board frame 20. A running board 22 is disposed on the running board frame 20. A running belt 23 is wound on the running board 22 and driven by a first motor 24 to revolve on the running board 22.

The linking mechanism 40 includes a supporting device 30 and a power telescopic rod. The supporting device 30 has two opposite caster supports 31 which are respectively pivotally mounted on the running board frame 20 in predetermined opposite positions. A first beam 32 is connected between the two caster supports 31. A second hinge 33 is fixed on the first beam 32. Two casters 34 are respectively mounted under the bottoms of the two caster supports 31. One of the caster supports 31 is further connected with a telescopic tube assembly 35. One end of an inner tube 351 of the telescopic tube assembly 35 is fixed on the caster support 31. One end of an outer tube 352 of the telescopic tube assembly 35 is pivotally mounted on the base seat 10. The telescopic tube assembly 35, the base seat 10, the caster support 31 and the running board frame 20 form a four-link mechanism A. The length of the inner tube 351 telescoped into the outer tube 352 is changeable so as to change the angle of the caster support 31, whereby the inclination of the running board frame 20 can be adjusted.

In this embodiment, the power telescopic rod via a second motor 41 is pivotally mounted on the first hinge 21 of the running board frame 20. The second motor 41 has a threaded rod 42 fitted in a short sleeve 43 connected with the second motor 41. A long sleeve 44 is fitted in the short sleeve 43. A locating block 441 is disposed at one end of the long sleeve 44. The locating block 441 has an inner thread 442 in which the threaded rod 42 is screwed. The other end of the long sleeve 44 is pivotally mounted on the second hinge 33 of the first beam 32. By means of rotating the threaded rod 42 of the second motor 41, the long sleeve 44 can move within the short sleeve 43 so as to ascend or descend the running board frame 20.

Figure 5:
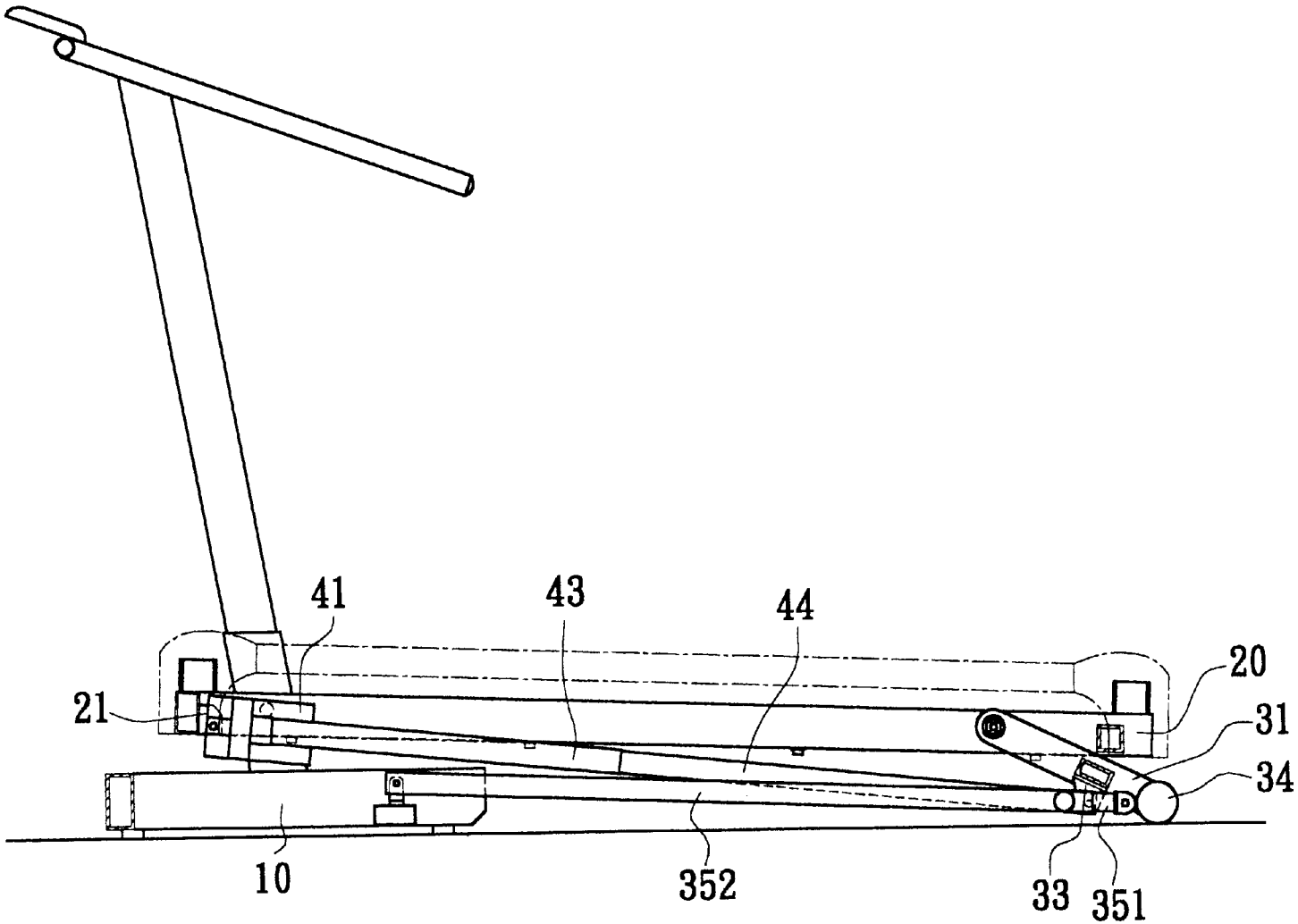
FIG. 5 is a side view of the present invention in a state prior to electric adjustment of the inclination of the running board.
Figure 6:
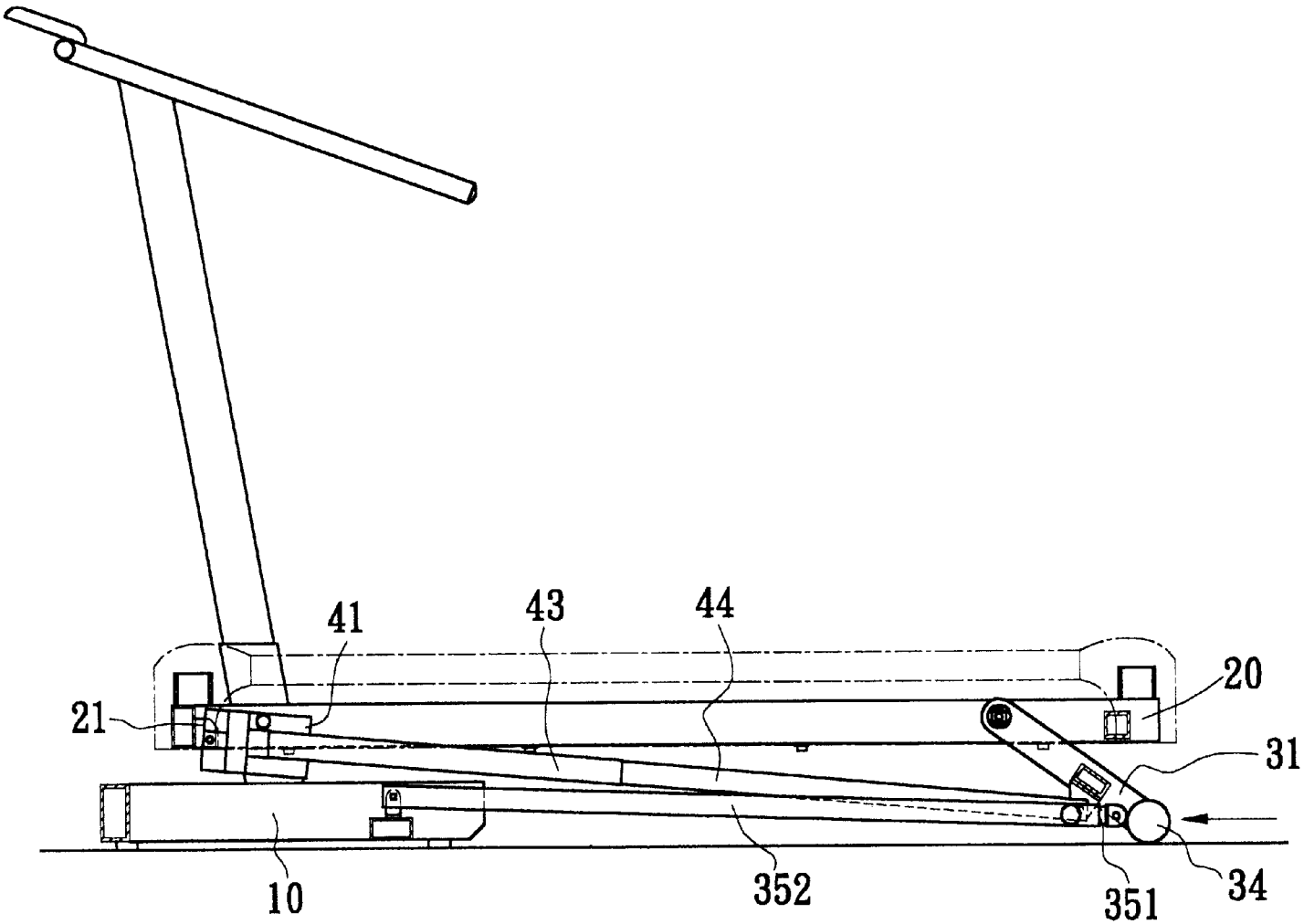
FIG. 6 is a side view of the present invention in a state after electric adjustment of the inclination of the running board.

Please refer to FIGS. 5 and 6. A user can press a press button (not shown) on the controller 13 to make the first motor 24 drive the running belt 23 to revolve on the running board 22. The user can run and exercise on the running belt 23. In addition, by means of pressing an inclination adjusting button on the controller 13, the second motor 41 is powered to drive the threaded rod 42 to rotate. The threaded rod 42 drives the locating block 441 of the long sleeve 44 and makes the long sleeve 44 move toward the short sleeve 43. At the same time, the first beam 32 of the supporting device 30 is driven to pivot the caster support 31. At this time, the inner tube 351 of the telescopic tube assembly 35 is telescoped into the outer tube 352 so as to change the inclination of the running board 22 on the running board frame 20. After the running board 22 reaches a position of a desired inclination, the user stops pressing the press button and the electric adjustment of inclination of the running board 22 is completed.

Figure 7:
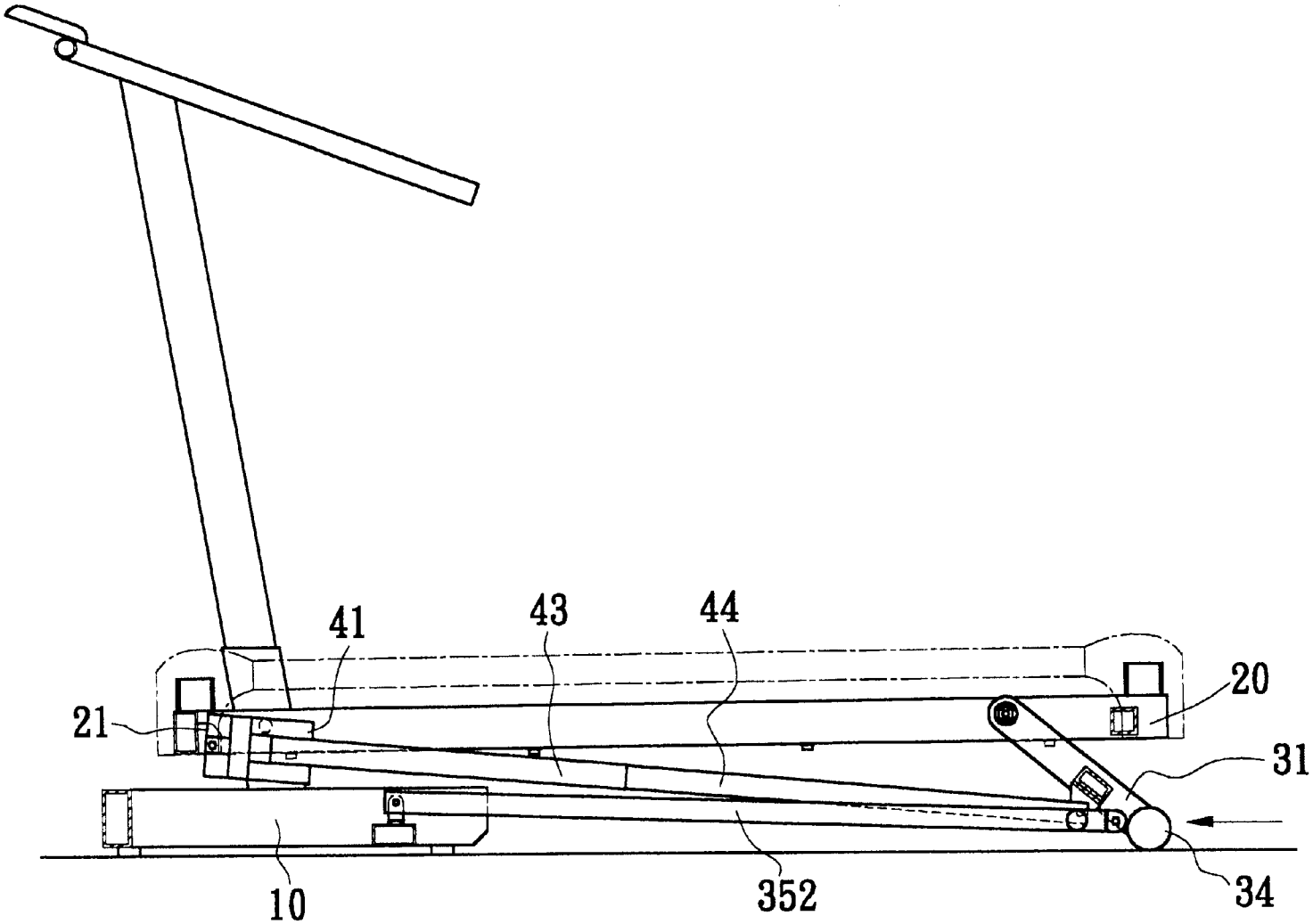
FIG. 7 is a side view of the present invention in a state prior to electric folding of the running board.
Figure 8:
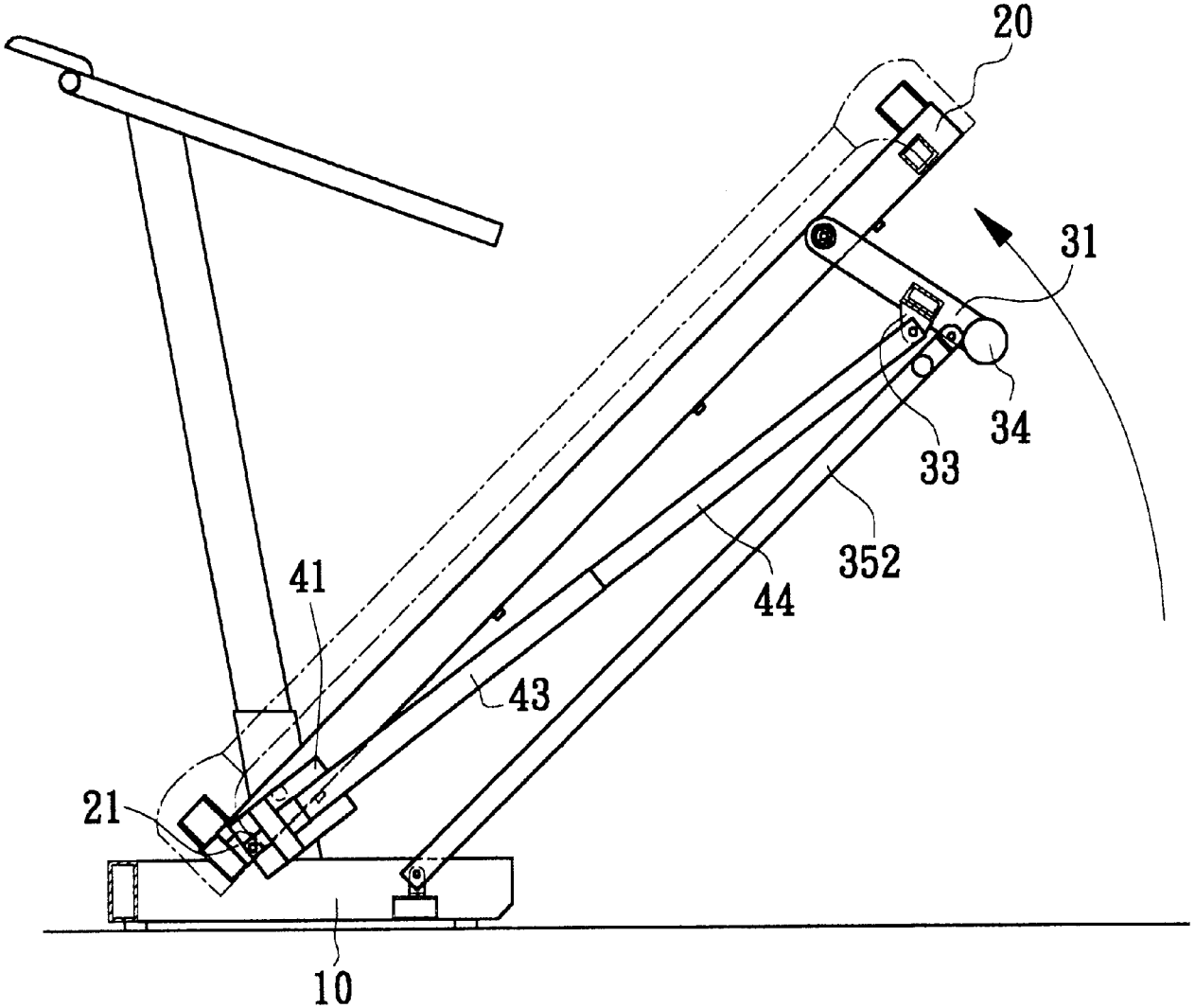
FIG. 8 is a side view of the present invention in which the running board is electrically folded by 45 degree angle.
Figure 9:
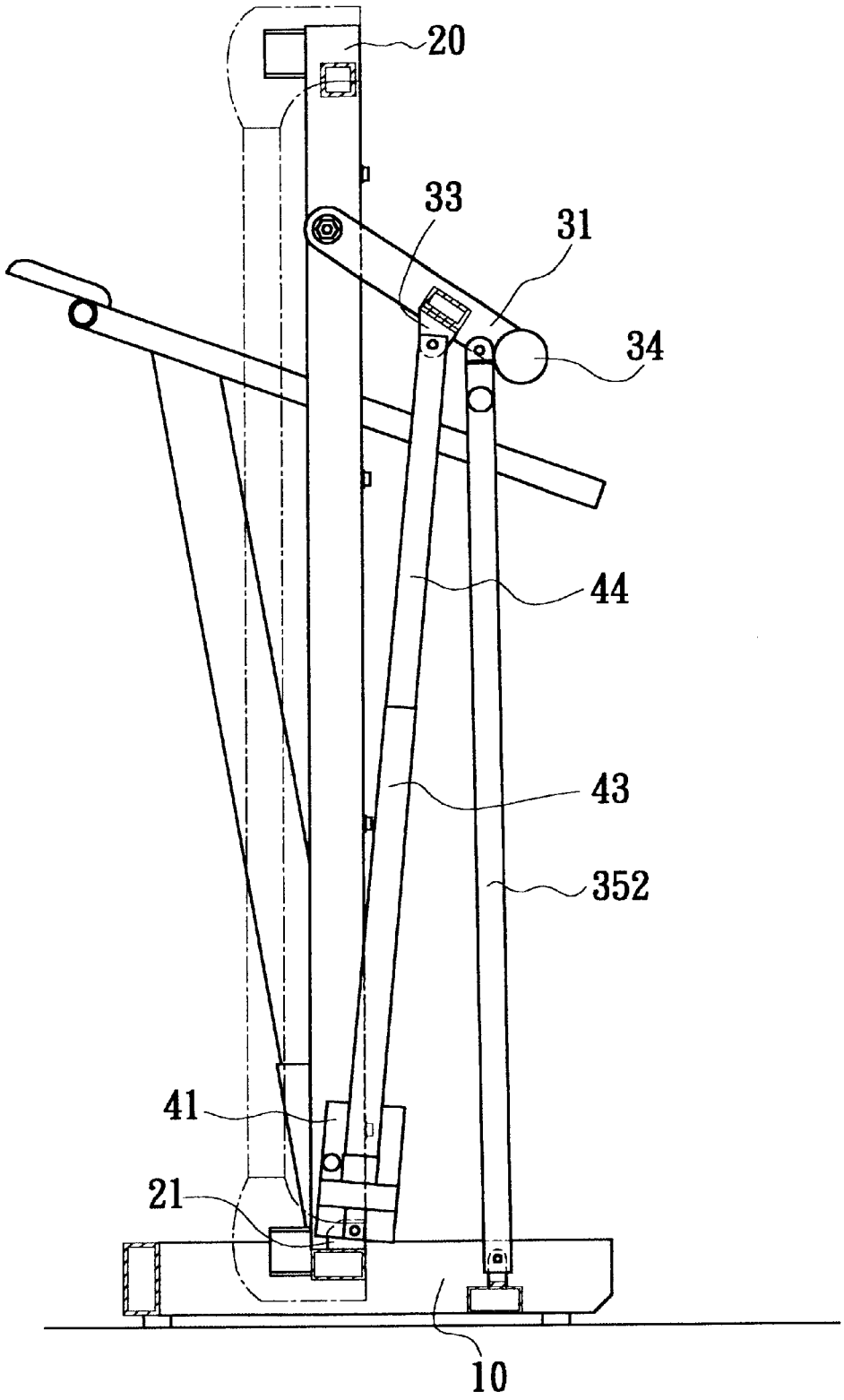
FIG. 9 is a side view of the present invention in which the running board is electrically folded by 90 degree angle.

Please refer to FIGS. 7 to 9. After the user completes the running exercise, the user can press a running board folding button on the controller 13 to make the second motor 41 drive the threaded rod 42. The threaded rod 42 is rotated to drive the locating block 441 of the long sleeve 44 and make the long sleeve 44 move toward the short sleeve 43. At the same time, the first beam 32 of the supporting device 30 is driven to pivot the caster support 31. At this time, the inner tube 351 of the telescopic tube assembly 35 is entirely telescoped into the outer tube 352 so that the angle of the caster support 31 cannot be further changed. Under such circumstance, the running board frame 20, the base seat 10, the telescopic rod 30 and the caster support 31 form a parallel four-link mechanism. By means of rotating the threaded rod 42 of the second motor 41, the long sleeve 44 is further telescoped into the short sleeve 43. The running board frame 20 is turned upward about the pivot point of the upright frames 11 of the base seat 10 until the running board frame 20 and the base seat 10 contain a 90 degree angle. At this time, the electric folding of the running board 22 is completed. Thereafter, the threaded rod 42 of the second motor 41 is fixed so that the long sleeve 44 is truly pulled and located to prevent the running board frame 20 from falling down.

Figure 10:
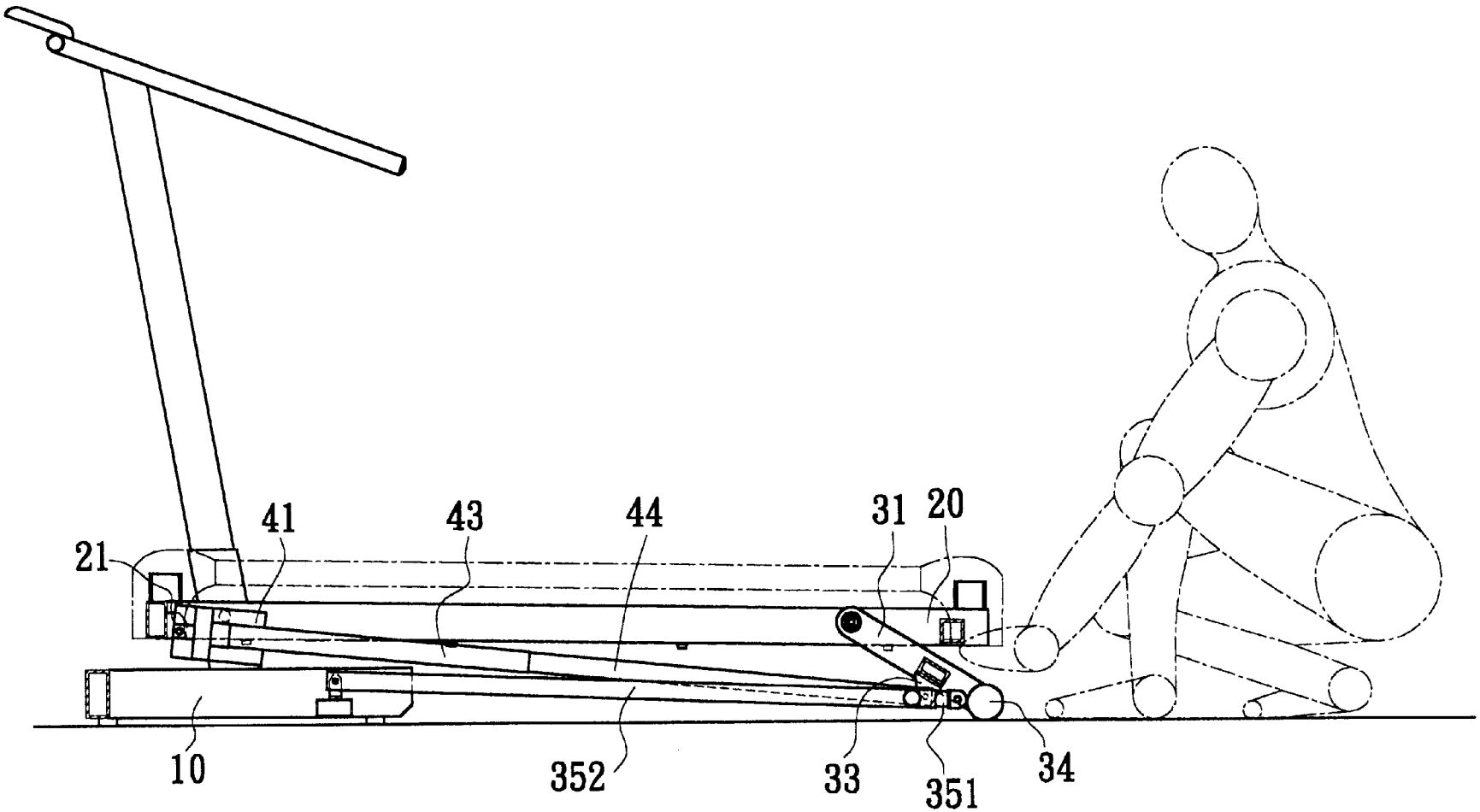
FIG. 10 is a side view of the present invention in a state prior to manual folding of the running board.
Figure 11:
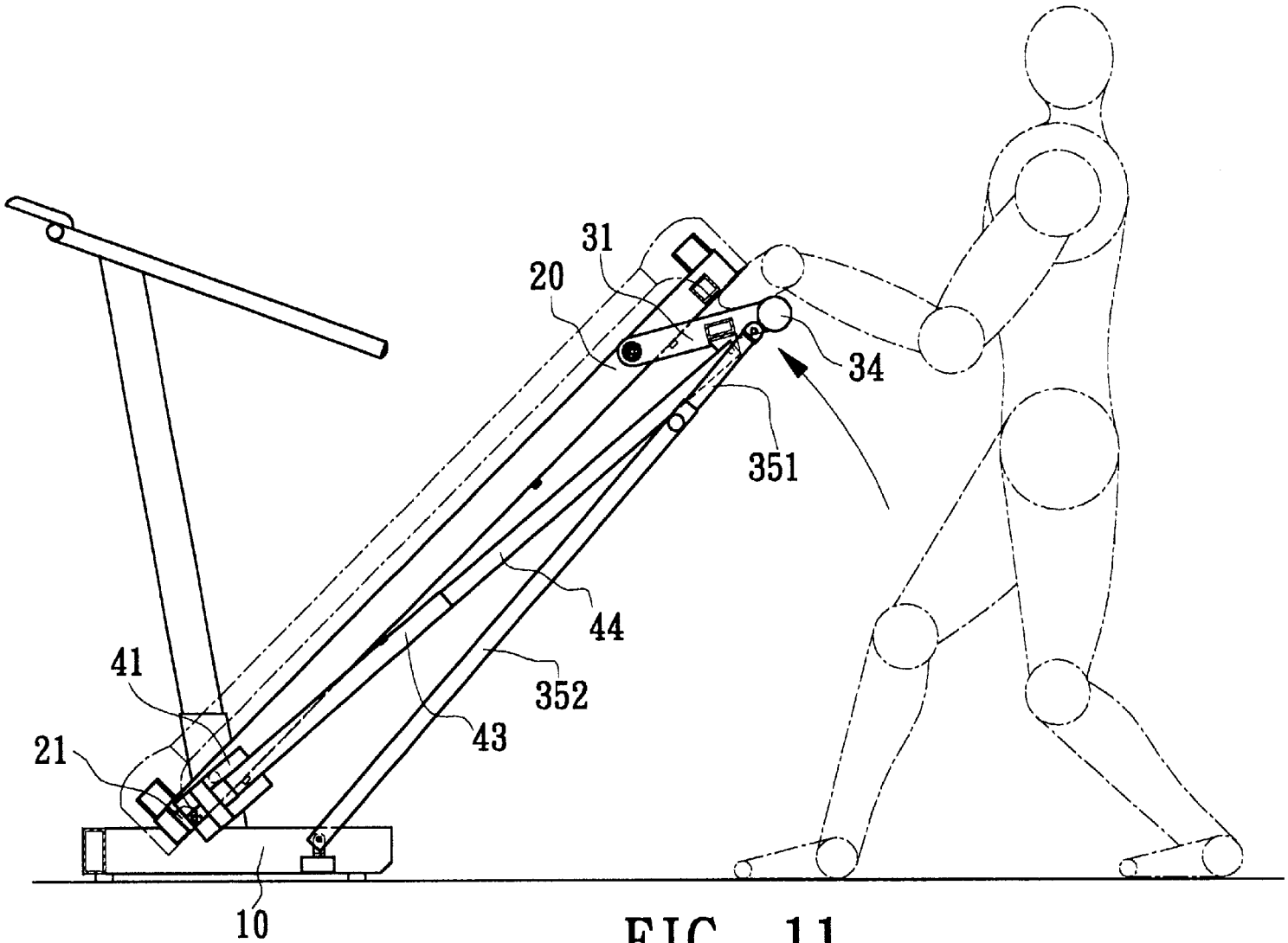
FIG. 11 is a side view of the present invention in which the running board is manually folded by 45 degree angle.
Figure 12:
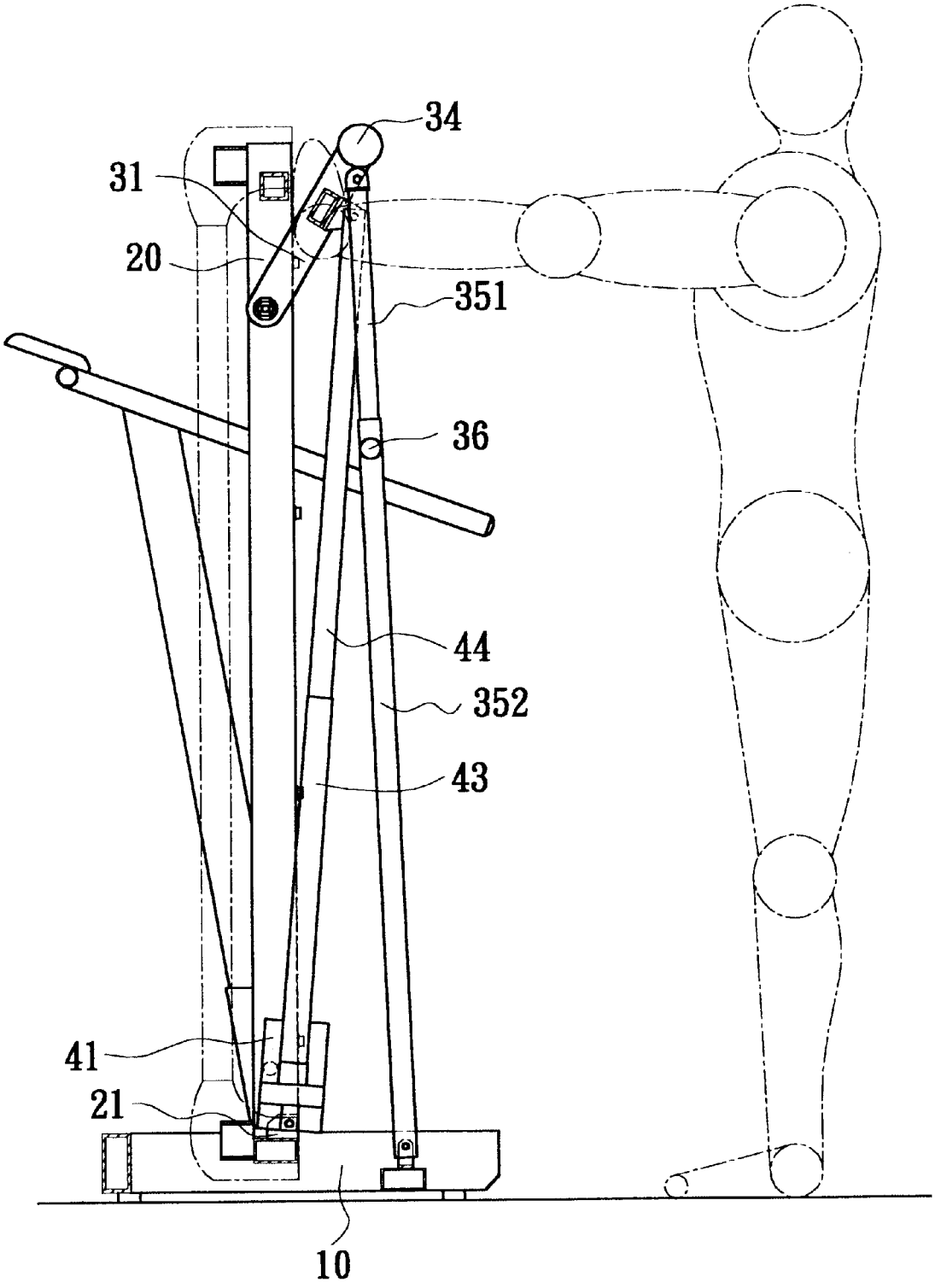
FIG. 12 is a side view of the present invention in which the running board is manually folded by 90 degree angle.
Figure 13:
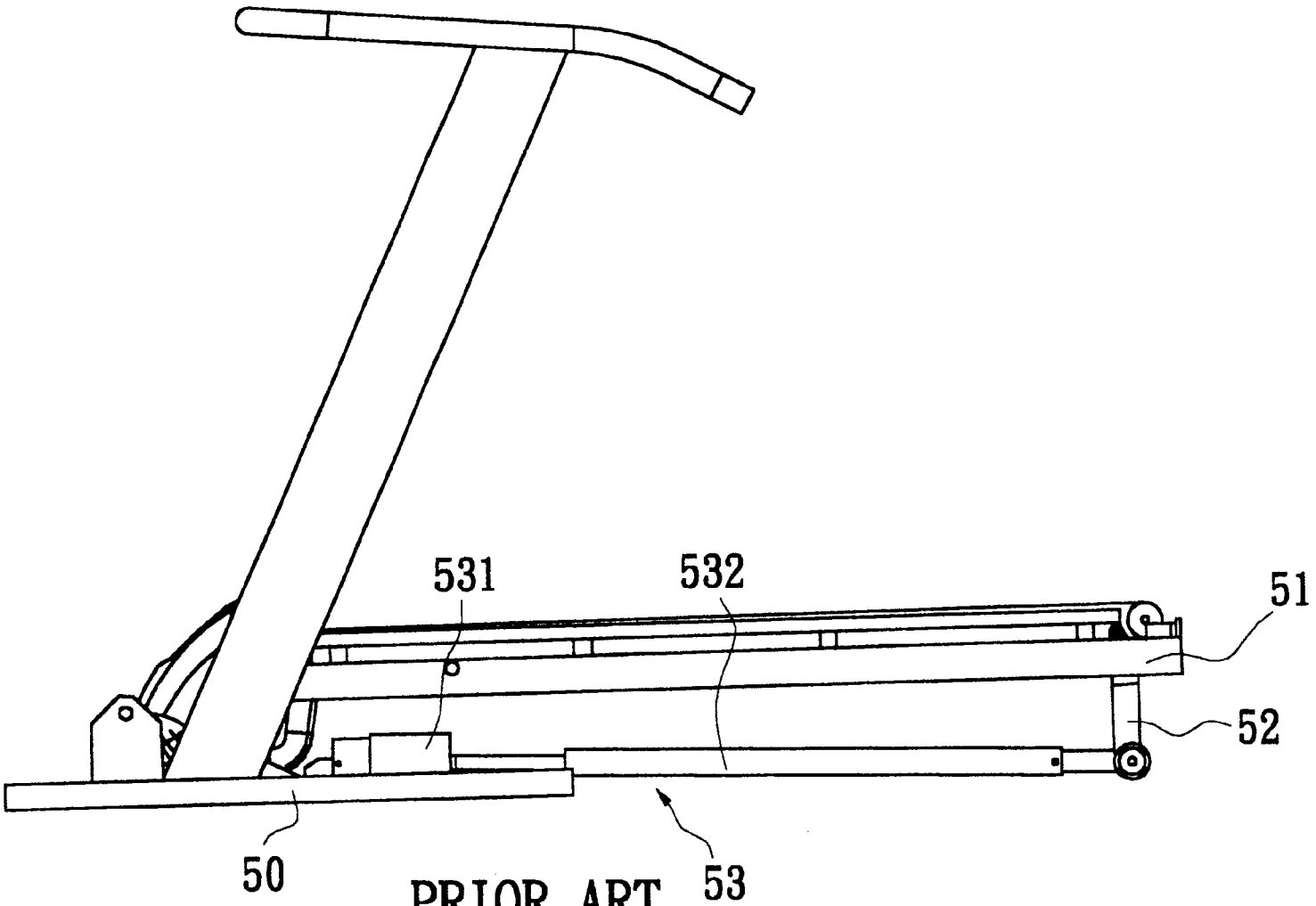
PRIOR ART FIG. 13
FIG. 13 is a side assembled view of a first conventional running exerciser.
Figure 14:
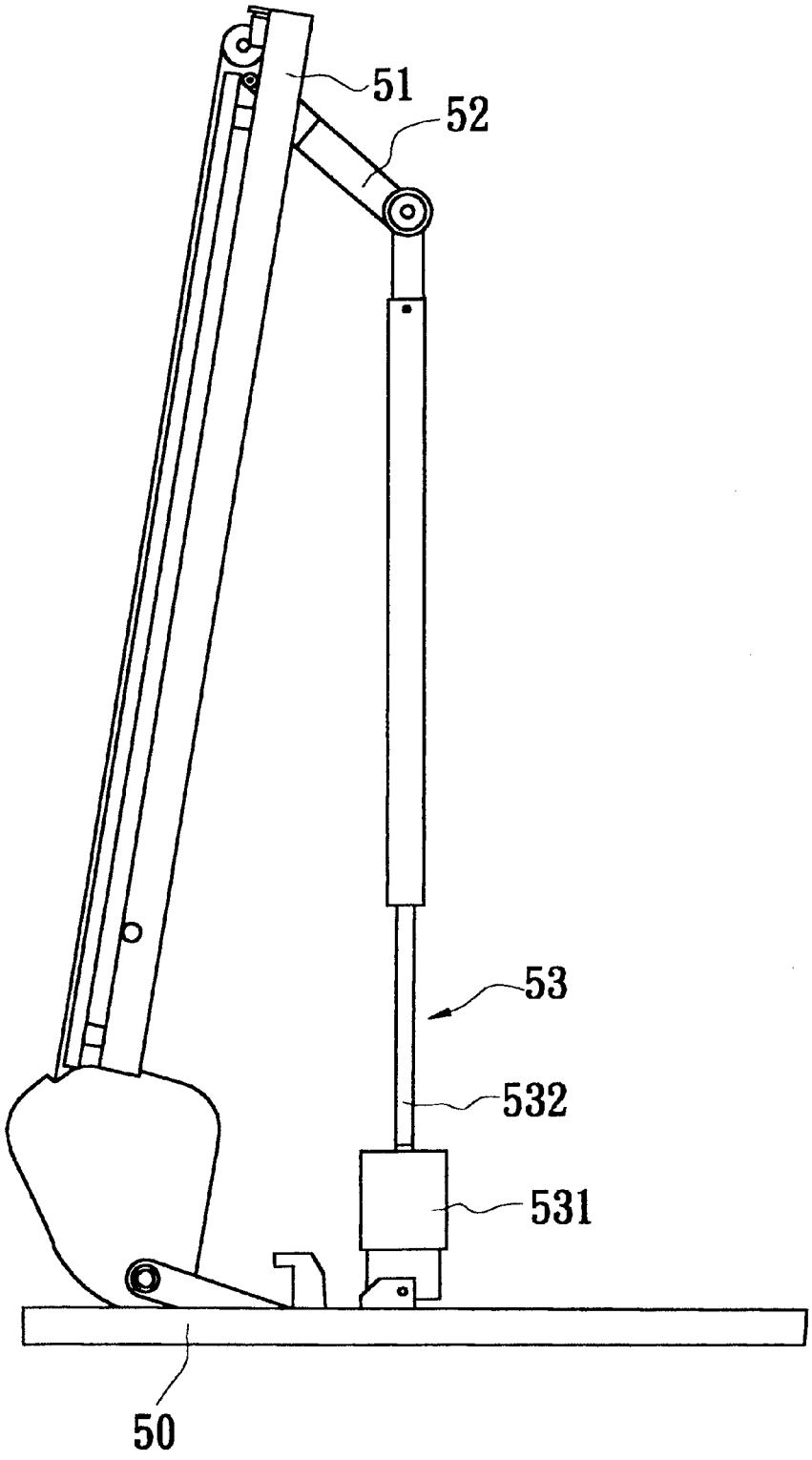
PRIOR ART FIG. 14
FIG. 14 is a side view of the first conventional running exerciser in a folded state.
Figure 15:
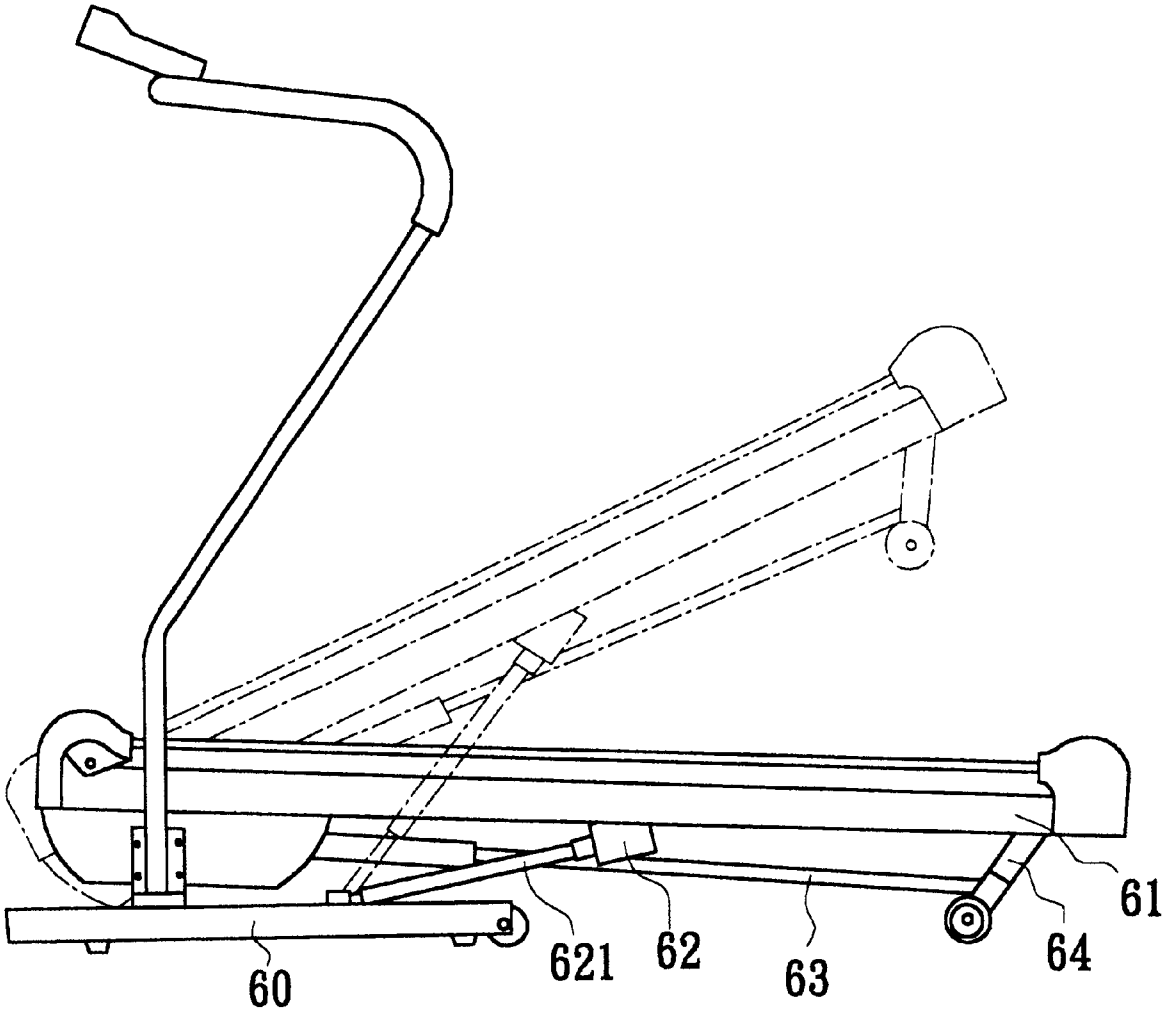
PRIOR ART FIG. 15
FIG. 15 is a side assembled view of a second conventional running exerciser.
Figure 16:
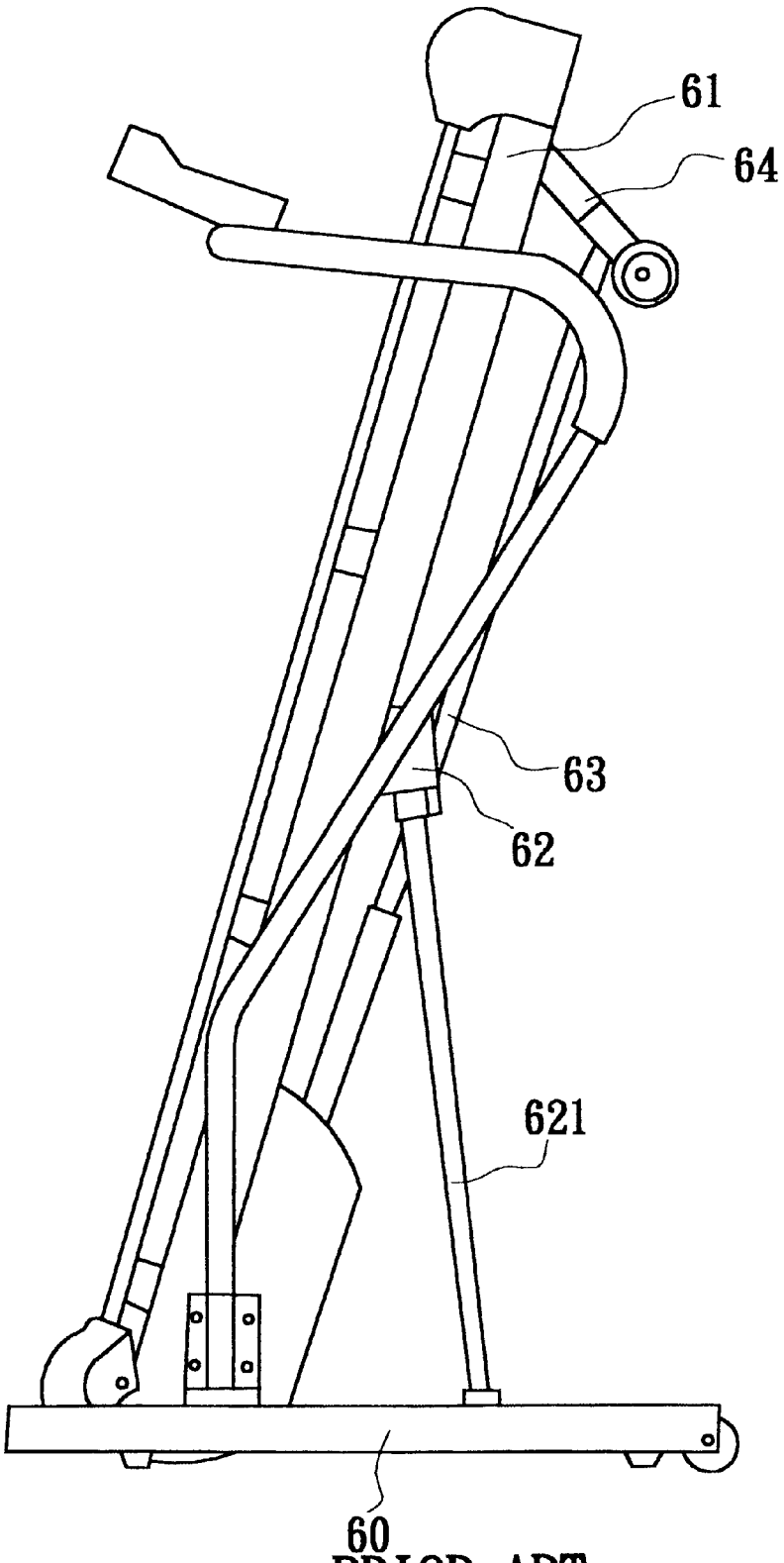
PRIOR ART FIG. 16
FIG. 16 is a side view of the second conventional running exerciser in a folded state.
Figure 17:
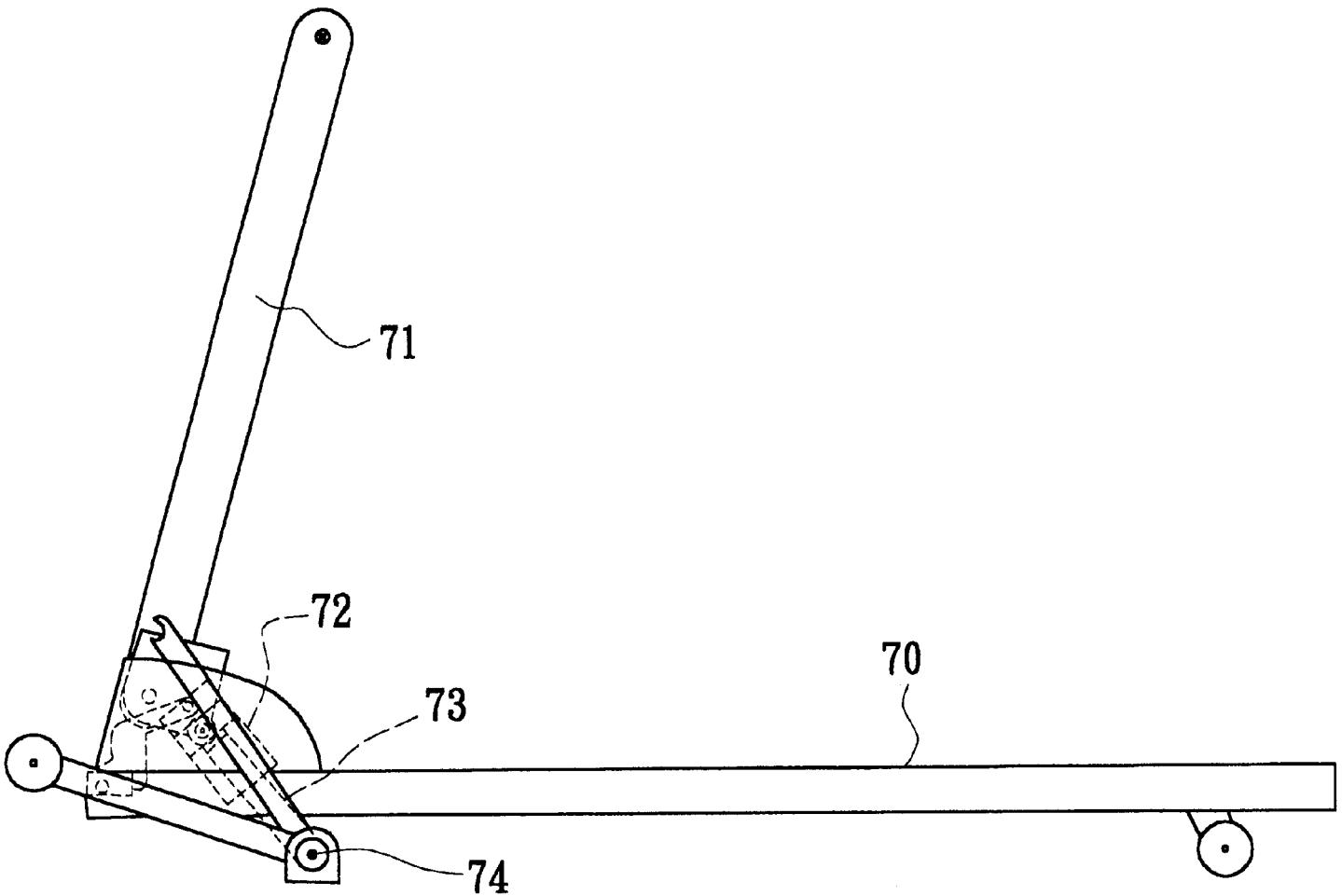
PRIOR ART FIG. 17
FIG. 17 is a side assembled view of a third conventional running exerciser.
Figure 18:
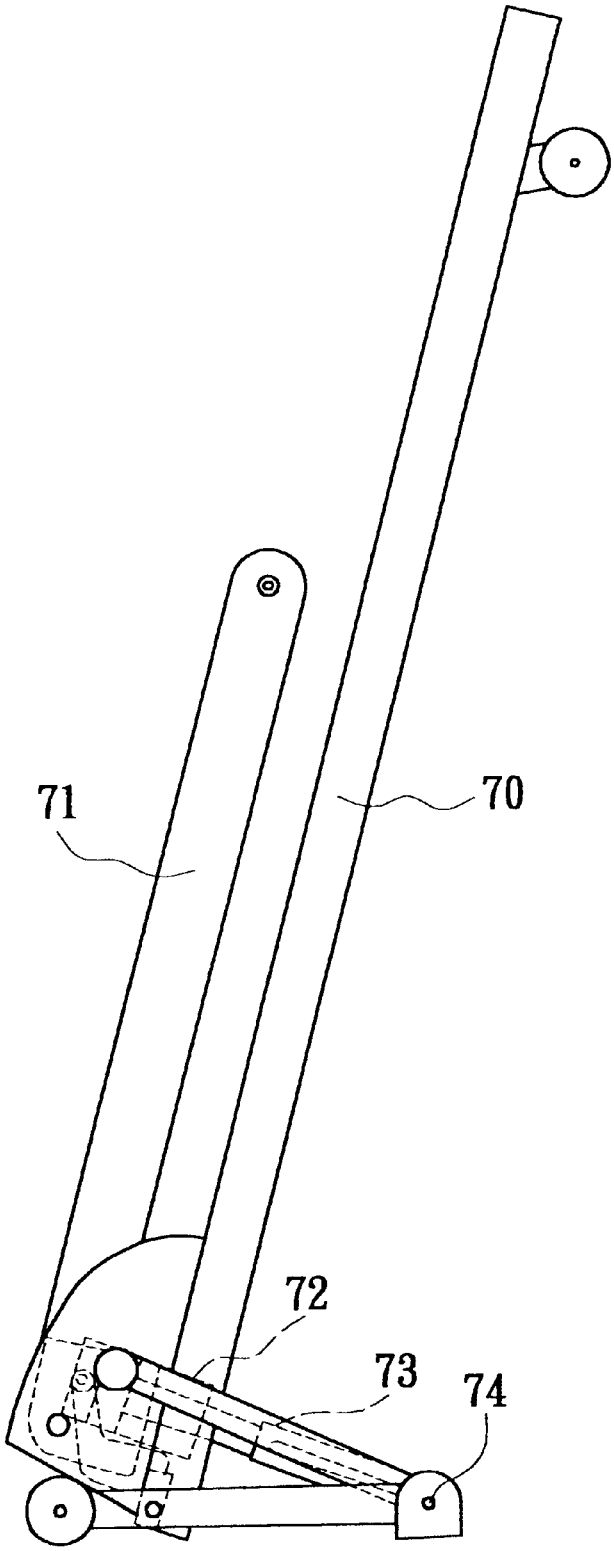
PRIOR ART FIG. 18
FIG. 18 is a side view of the third conventional running exerciser in a folded state.

Referring to FIGS. 10 to 12, in the case that there is no power supply and the user desires to fold the running board 22, the user can directly use his/her hands to turn the rear end of the running board frame 20 upward about the pivot section of the running board frame 20 and the base seat 10. With a 90 degree angle contained between the running board frame 20 and the base seat 10, a locating bolt 36 is passed through the telescopic tube assembly 35 to lock the inner tube 351 with the outer tube 352 without telescoping. At this time, the running board frame 20 is fixed in a folded state. Accordingly, in the case that there is no power supply, a user can still conveniently manually fold the running board.

In conclusion, in the ascending/descending and folding structure for running exerciser of the present invention, the running board frame is connected with a linking mechanism and driven thereby. A telescopic tube assembly of a supporting device is telescoped so as to move the caster support back and forth for adjusting the inclination of the running board. By means of rotating a threaded rod, a long sleeve of the linking mechanism is telescoped into a short sleeve, whereby the running board frame is turned upward. Therefore, the running board can be electrically folded. In the case that there is no power supply, a user can directly manually turn the running board upward and fold the running board.

The above embodiments are only used to illustrate the present invention, not intended to limit the scope thereof. Many modifications of the above embodiments can be made without departing from the spirit of the present invention.

What is claimed is:

1. An ascending/descending and folding structure for running exerciser, comprising:

a base seat having two pivot sections on two sides thereof;

a running board frame, two sides of one end of the running board frame being respectively pivotally mounted on the two pivot sections of the base seat, a running board being disposed on the running board frame, a running belt being wound around the running board; and a linking mechanism capable of adjusting the inclination of the running board frame and folding the running board frame, the linking mechanism including a supporting device and a power telescopic rod, the supporting device having a caster support pivotally mounted under the running board frame in a predetermined position distal from the end of the running board frame pivotally connected with the base seat, at least one caster being disposed under the bottom of the caster support, the caster support being pivotally connected with one end of a telescopic tube assembly, the other end of the telescopic tube assembly being pivotally mounted on the base seat, the telescopic tube assembly, the base seat, the caster support and the running board frame forming a four-link mechanism, one end of the power telescopic rod being pivotally mounted on the caster support, while the other end thereof being pivotally mounted on the running board frame, the power telescopic rod being driven by a power source.

2. The ascending/descending and folding structure for running exerciser as claimed in claim 1, wherein the pivot sections on two sides of the base seat are two upright frames, an upright column being fitted in each upright frame, a rail having a controller being connected between the two upright columns.

3. The ascending/descending and folding structure for running exerciser as claimed in claim 1, wherein the linking mechanism via a second motor is pivotally mounted on the running board frame, the second motor having a threaded rod fitted in a short sleeve connected with the second motor, a long sleeve being fitted in the short sleeve, a locating block being disposed at one end of the long sleeve, the locating block having an inner thread in which the threaded rod is screwed, the other end of the long sleeve being pivotally mounted on the caster support.

4. The ascending/descending and folding structure for running exerciser as claimed in claim 1, wherein one end of the inner tube of the telescopic tube assembly is fixed on the caster support, an outer tube being fitted around the inner tube, one end of the outer tube being pivotally mounted on the base seat.

* * * * *